United States Patent [19]

Kirby

[11] Patent Number: 5,037,293

[45] Date of Patent: Aug. 6, 1991

[54] CATALYTIC HEATER

[76] Inventor: Alan Kirby, 3880 - 74 Avenue, Edmonton, Alberta, Canada, T6B 2P7

[21] Appl. No.: 541,730

[22] Filed: Jun. 21, 1990

[51] Int. Cl.[5] ..... F23D 14/12

[52] U.S. Cl. ..... 431/328

[58] Field of Search ..... 431/328, 329; 126/92 R

[56] References Cited

U.S. PATENT DOCUMENTS

| | | | |
|---|---|---|---|
| 3,245,459 | 4/1966 | Keith | 431/329 |
| 3,270,798 | 9/1966 | Ruff | 431/329 |
| 3,574,506 | 4/1971 | Locke | 431/344 |
| 3,833,338 | 9/1974 | Badrock | 431/329 |
| 4,483,673 | 11/1984 | Murai et al. | 431/328 |

*Primary Examiner*—Carroll B. Dority

*Attorney, Agent, or Firm*—George Haining Dunsmuir

[57] ABSTRACT

In general, catalytic heaters which rely on ambient air for operation are self limiting. A simple, effective solution to the problem includes a casing with an open front end, a screen on such front end, a catalyst pad in the casing behind the screen, and diffuser pads for receiving a gas/air fuel mixture from a mixer which creates the mixture and introduces the mixture through the rear wall of the casing. Channels or dikes in the diffuser pads ensure even distribution of the gas/air fuel mixture to the catalyst pad.

13 Claims, 5 Drawing Sheets

CATALYTIC HEATER

BACKGROUND OF THE INVENTION

This invention relates to a catalytic heater. The device of the present invention was specifically designed for use in a pipe heating apparatus of the type disclosed in applicant's co-pending Canadian patent application, Ser. No. 2,004,221, filed Nov. 29, 1989. However, the heater of the present invention can be used in other situations requiring a catalytic heater.

When using flameless, gas fired, catalytic heaters, it is common practice to introduce fuel into a gas-tight housing where the fuel expands to fill the housing completely. As the fuel passes through the catalyst bed located on the front surface of the housing, ambient air mixes with the fuel permitting catalytic oxidation to occur in the catalyst bed. The catalyst bed usually consists of platinum group metals or compounds carried on a ceramic wool or ceramic board. The products of the catalytic reaction, namely carbon dioxide and water vapour pass are discharged through the front surface of the catalyst bed. Convection currents dissipate the products of reaction and re-introduce oxygen from the atmosphere to sustain the catalytic reaction.

The main limiting factor controlling the rate of catalytic reaction per unit area of catalyst bed is the rate of convection flow over the active catalytic surface. The rate of reaction is greatly reduced when the catalyst bed is horizontal, because convection circulation is substantially reduced. One solution to the problem is the use of fans to increase air flow of the catalytic surface.

The object of the present invention is to offer a more effective solution to the above defined problem by providing a relatively simple catalytic heater, in which a gas/air mixture is introduced into the heater so that a substantially large quantity of fuel mixture is uniformly delivered to the catalyst bed.

The use of the heater of the present invention permits substantial increases (as high as 33%) in heat output per unit area of catalyst bed. Moreover, the introduction of a fuel mixture into a housing under pressure dramatically reduces the problem of operating a catalytic heater upside down or face down, i.e. there appears to be no reaction in the rate of catalytic reaction when the heater is operated face down.

BRIEF SUMMARY OF THE INVENTION

According to the invention there is provided a catalytic heater comprising casing means, said casing means including side walls, a rear wall and end walls; screen means closing the open front end of said casing means; catalyst pad means in said casing means adjacent to said screen means; diffuser pad means in said casing means between said catalyst pad means and said rear wall for distributing a fuel mixture to said catalyst pad means; and inlet means in said rear wall of said casing means for introducing a gas/air fuel mixture into said casing means.

BRIEF DESCRIPTION OF THE DRAWINGS

The invention will be described in greater detail with reference to the accompanying drawings, which illustrate preferred embodiments of the invention, and wherein.

DESCRIPTION OF THE PREFERRED EMBODIMENT(S)

Figure 2:
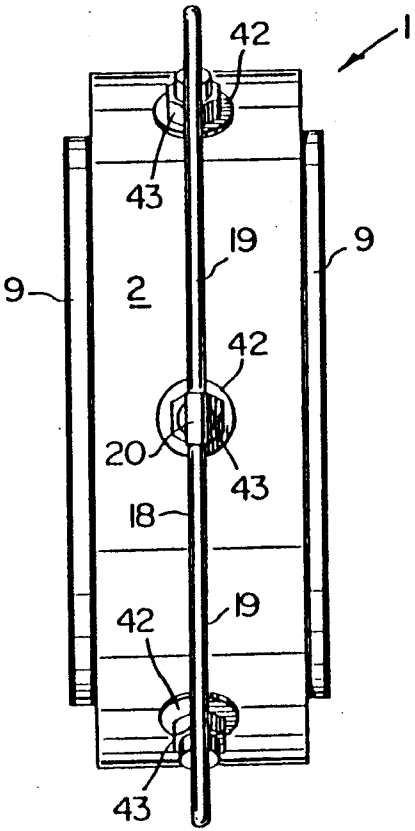
FIG. 2 is a rear view of the catalytic heater of FIG. 1.
Figure 1:
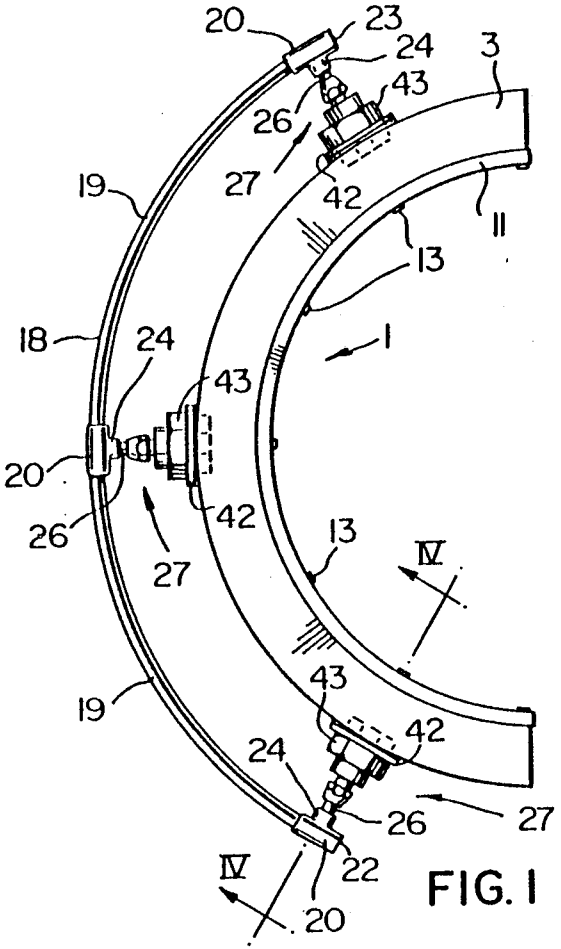
FIG. 1 is a side view of a catalytic heater in accordance with the present invention.
Figure 4:
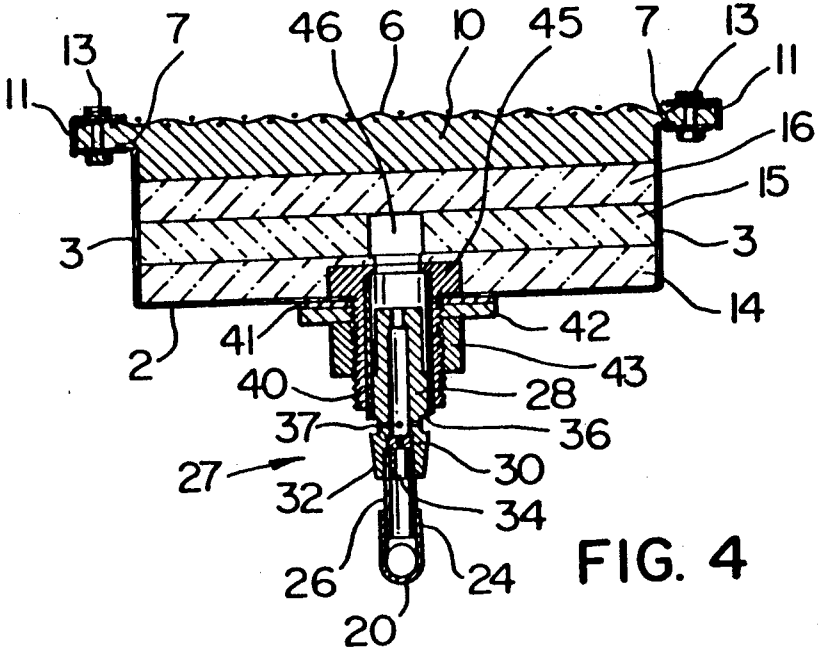
FIG. 4 is a cross section taken generally along line IV—IV of FIG. 1.
Figure 3:
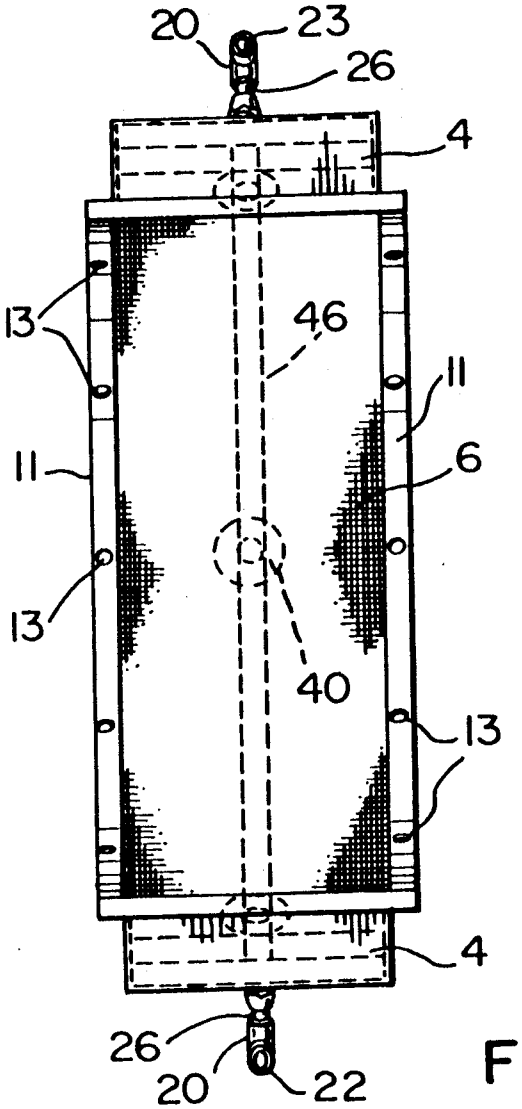
FIG. 3 is a front view of the catalytic heater of FIGS. 1 and 2.
Figure 5:
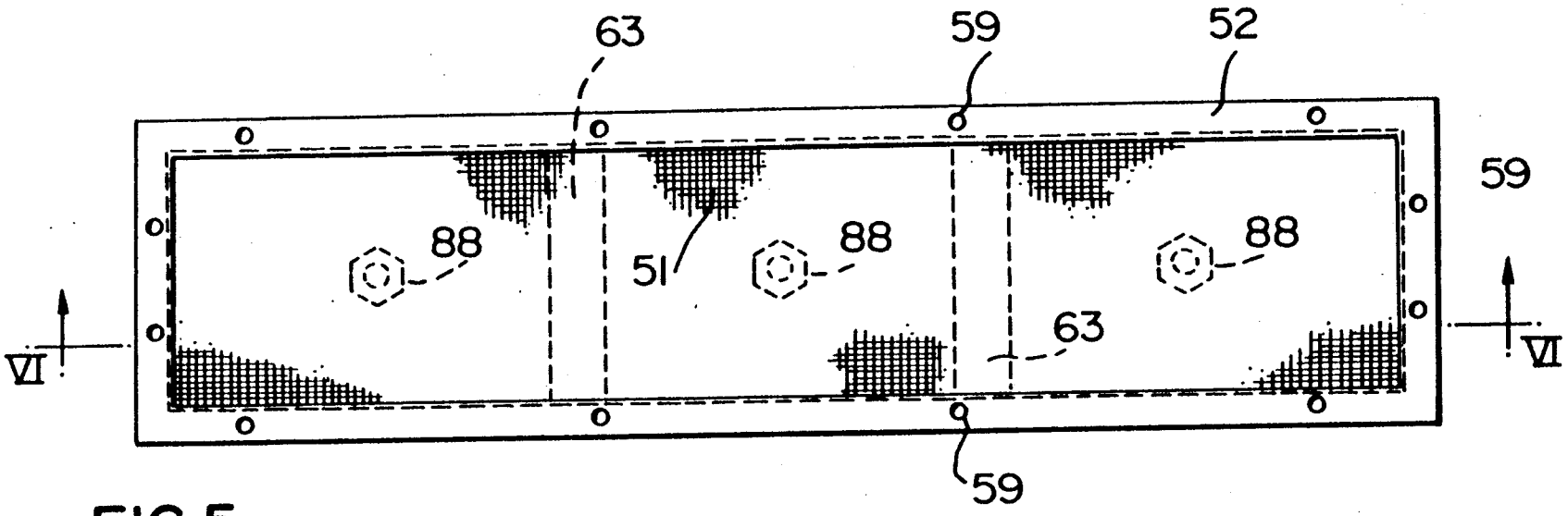
FIG. 5 is a front view of a second embodiment of the catalytic heater in accordance with the present invention.
Figure 6:
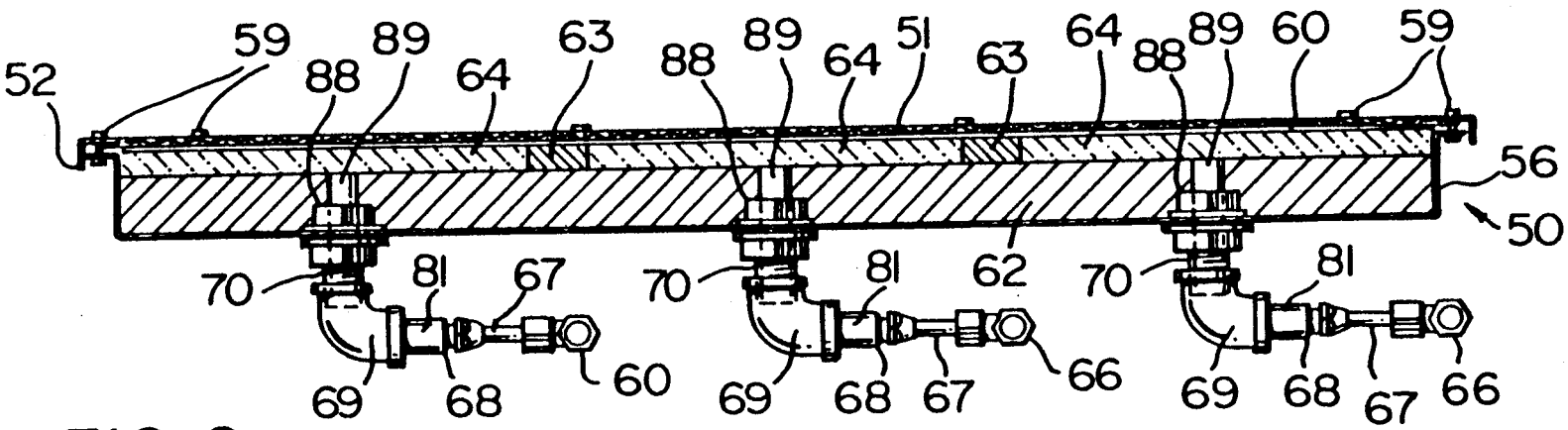
FIG. 6 is a cross section taken generally along line VI—VI of FIG. 5.
Figure 8:
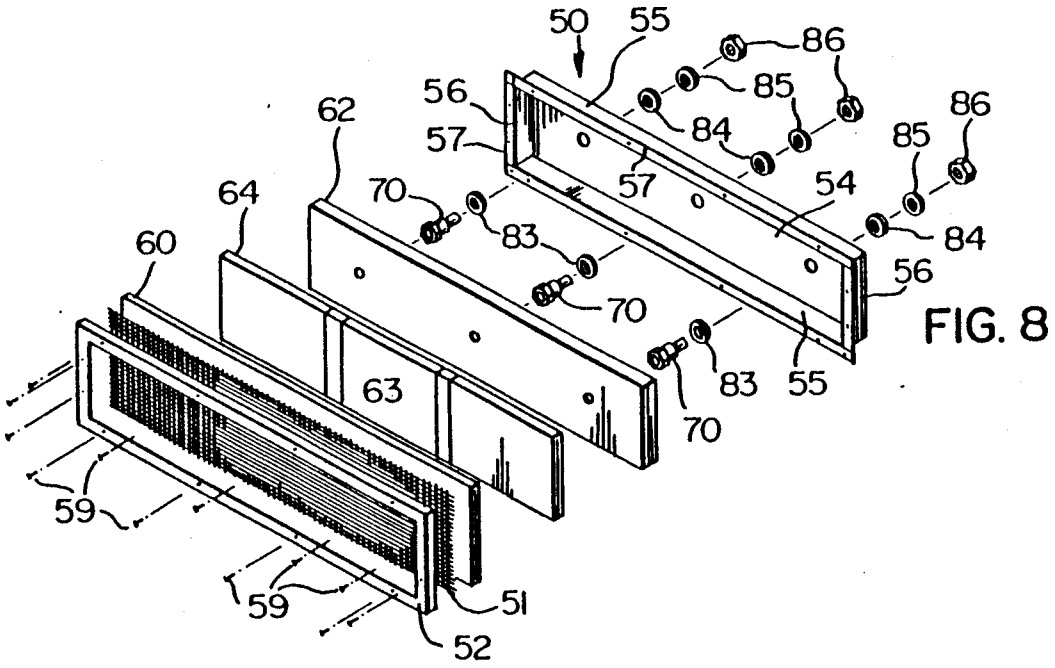
FIG. 8 is an exploded, isometric view of the catalytic heater of FIGS. 5 to 7.
Figure 7:
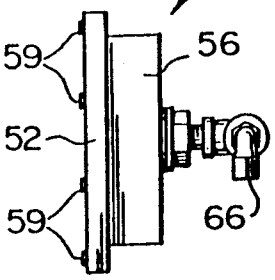
FIG. 7 is an end view of the catalytic heater of FIGS. 5 and 6.

Referring to FIGS. 1 to 4, one embodiment of the catalytic heater of the present invention includes a semi-cylindrical housing generally indicated at 1. The housing, which is generally rectangular in cross section, is defined by integral rear and side walls 2 and 3, respectively. The open front end of the housing is closed by a screen 6. Flanges 7 are provided on the front, free ends of the side walls 3 for supporting a ledge 9. A catalyst pad 10 and the screen 6 are sandwiched between the ledge 9 and a bezel or frame 11 of generally L-shaped cross section. The bezel 11 is connected to the ledge 9 by a plurality of spaced apart rivets 13. Three ceramic fiber pads or layers 14, 15 and 16 are sandwiched between the rear wall 2 of the casing 1 and the catalyst pad 10. In this case, the pads are formed of Kaowool (trade-mark), but other ceramic fiber may be used in such pads.

Gas is introduced into the rear of the housing 1 via an inlet manifold 18. The manifold is defined by a plurality of lengths of pipe 19 interconnected by tee joints 20. Gas under pressure is introduced into one end 22 of the manifold 18. The other end 23 of the manifold 18 is either plugged or connected to additional catalytic heaters (not shown). At least some of the gas entering each tee joint 20 is discharged through the stem 24 of the joint into a short tube 26, which extends into a gas-/air mixer generally indicated at 27.

The mixer 27 (FIG. 4) is defined by an elongated tubular body 28 with a disc 30 containing a restricted orifice mounted therein near the outwardly tapering inlet end 32. The restricted orifice creates a low pressure area in the mixer 27 downstream of the orifice in the direction of gas flow. The disc 30 is on one end of a short tube 34, which is inserted into the externally threaded end of the tube 26 for retaining the latter and the disc in the internally threaded inlet end 32 of the mixer body 28. An annular groove 36 is provided in the body 28 downstream of the orifice 31 in the direction of gas flow. A plurality (in this case four) of radially extending openings 37 in the bottom of the groove 36 admit air to the gas stream, i.e. air is drawn into the low pressure area of the gas stream for mixing therewith. The body 28 is mounted in a sleeve 38 which extends into a tubular connector or so-called spud 40. The connector 40 is externally threaded for receiving a gasket 41, a washer 42 and a nut 43. The enlarged inner end or head 45 of the connector engages the outer wall 2 of the housing 1 to retain the connector in the housing. Thus, the connector 40 is in the form of a hollow bolt.

Gas and air entering the housing 1 are discharged into a passage 46 extending the length of the intermediate layer 15 of ceramic fiber. The provision of the passage 46 ensures the uniform flow of gas along the entire length of the heater.

With reference to FIGS. 5 to 8, a flat version of the catalytic heater includes a rectangular housing generally indicated at 50, the open front end of which is closed by a screen 51 and an L-shaped cross section bezel or frame 52. The housing 50 is defined by integral rear and side walls 54 and 55, respectively and end walls 56. Flanges 57 extending outwardly from the inner free ends of the side and end walls receive rivets 59 (FIGS. 5 to 8) for connecting the frame 52 to the housing 50. The housing 50 contains a catalyst pad 60, a high density rear ceramic fiber pad 62, high density transversely extending ceramic fiber dikes 63, and low density front ceramic fiber pads 64.

Figure 9:
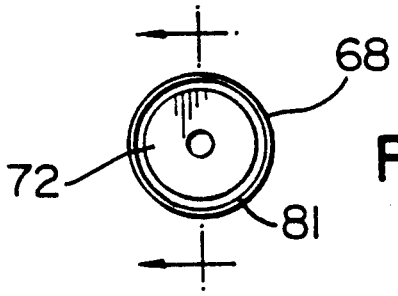
FIGS. 9 and 10 are end views of a mixer used in the heater of FIGS. 5 to 8.
Figure 10:
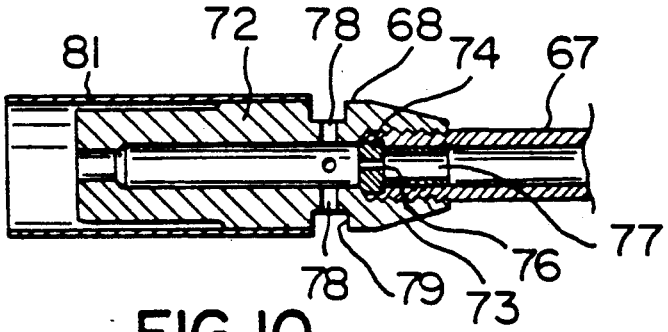
Figure 11:
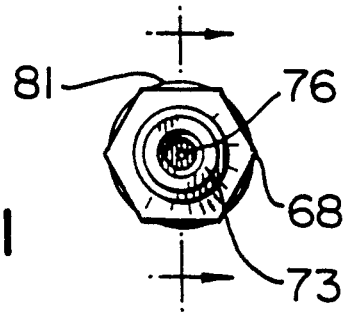
FIG. 11 is a longitudinal sectional view of the mixer of FIGS. 9 and 10.

A gas/air mixture is introduced into the housing 50 via elbows 66, tubes 67, mixers 68, second elbows 69 and inlet connectors 70. The elbows 66 are connected to a source of gas under pressure. The mixer 68 (FIGS. 9 to 11) like the mixer 27, includes an elongated body 72 with an internally threaded, tapering inlet end 73 for receiving the tube 67, a disc 74 with a restricted orifice 76 and a short tube 77. A plurality of radially extending air inlet openings 78 are provided in an annular groove 79 in the body downstream of the orifice 76 in the direction of gas flow. A sleeve 81 on the body 72 extends into the elbow 69.

The connector 70 is similar to the connector 40, including external threads for receiving a washer 83 in the casing 50, and a gasket 84, a washer 85 and a nut 86 outside of the casing 50. A gas/air mixture is discharged through the hexagonal head 88 of the connector 40 into a short cylindrical passage 89 through the pad 62. The passage 89 communicates with the centre of the pad 64. The dikes 63 form boundaries between cells containing the pads 64, which act as diffusers for uniform delivery of fuel mixture to the catalyst pad 60.

What is claimed is:

1. A catalytic heater comprising:

a) casing means, said casing means including side walls, a rear wall and end walls; screen means closing an open front end of said casing means; catalyst pad means in said casing means adjacent to said screen means; diffuser pad means in said casing means between said catalyst pad means and said rear wall for distributing a fuel mixture to said catalyst pad means; and inlet means in said rear wall of said casing means for introducing the fuel mixture into said casing means;

b) said diffuser pad means includes a first, high density ceramic fiber pad adjacent said rear wall, a plurality of low density ceramic second fiber pads between said first pad and said catalyst pad means, and high density ceramic fiber dike means separating said second fiber pads from each other; and c) said inlet means includes separate inlets for introducing the fuel mixture into each of said second pads.

2. A catalytic heater according to claim 1, wherein said inlet means includes mixer means connected to a source of gas under pressure for receiving gas therefrom and for introducing air into the gas to create the fuel mixture.

3. A catalytic heater according to claim 2, wherein said mixer means includes an elongated tubular body for conveying gas to said casing means; restricted orifice means in said body through which the gas passes to create a low pressure zone in said body, and radial openings in said body communicating with said low pressure zone for introducing air into the gas in said body.

4. A catalytic heater according to claim 1, wherein said diffuser pad means includes a first ceramic fiber pad adjacent said rear wall, a second ceramic fiber pad adjacent said catalyst pad, and a third ceramic fiber pad intermediate said first and third pads.

5. A catalytic heater according to claim 4, wherein passage means extends centrally along the length of said second pad.

6. A catalytic heater according to claims 1, 2, 3, 4 or 5, wherein said casing means is semicylindrical, and said screen means is located on the interior side of the cylinder.

7. A catalytic heater according to claim 1, wherein said inlet means includes means for introducing a fuel mixture into the centre of each said second fiber pad, ensuring uniform distribution of said mixture in each said second fiber pad.

8. A catalytic heater comprising:

a) casing means including side walls, a rear wall and end walls and an open front end;

b) screen means closing the open front end of said casing means;

c) catalyst pad means in said casing means adjacent to said screen means;

d) diffuser pad means in said casing means between said catalyst pad means and said rear wall for distributing a fuel mixture to said catalyst pad means;

e) inlet means in said rear wall of said casing means for introducing the fuel mixture into said casing means;

f) said diffuser pad means having a first portion forming a uniform layer between said casing means and said catalyst pad means;

g) said diffuser pad means having second and third portions located between said first portion and said casing means;

h) said second and third portions being spaced apart a sufficient distance to form a distinct passage; and, i) whereby, the passage promotes the uniform flow of the fuel mixture along the length of said casing means.

9. A catalytic heater according to claim 8, wherein said inlet means includes mixer means connected to a source of gas under pressure for receiving gas therefrom and for introducing air into the gas to create the fuel mixture.

10. A catalytic heater according to claim 9, wherein said mixer means includes an elongated tubular body for conveying gas to said casing means; restricted orifice means in said body through which the gas passes to create a low pressure zone in said body, and radial openings in said body communicating with said low pressure zone for introducing air into the gas in said body.

11. A catalytic heater according to claim 8, wherein said diffuser pad means includes a first ceramic fiber pad adjacent said rear wall, a second ceramic fiber pad adjacent said catalytic pad, and a third ceramic fiber pad intermediate said first and third pads.

12. A catalytic heater according to claim 11, wherein said passage means extends centrally along the length of said second pad.

13. A catalytic heater according to claim 8, wherein said casing means is semicylindrical, and said screen means is located on the interior side of the cylinder.

* * * * *